US007500530B2

(12) United States Patent
Wheeler

(10) Patent No.: US 7,500,530 B2
(45) Date of Patent: Mar. 10, 2009

(54) CONTROL SYSTEM

(75) Inventor: Justin Wheeler, Mansfield, OH (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 11/657,370

(22) Filed: Jan. 24, 2007

(65) Prior Publication Data

US 2007/0169964 A1 Jul. 26, 2007

Related U.S. Application Data

(60) Provisional application No. 60/761,991, filed on Jan. 25, 2006.

(51) Int. Cl.
*E21B 44/00* (2006.01)

(52) U.S. Cl. ..... 175/26; 175/24; 175/40; 175/62

(58) Field of Classification Search ..... 175/24, 175/26, 40, 62

See application file for complete search history.

(56) References Cited

U.S. PATENT DOCUMENTS 6,668,946 B2 * 12/2003 Rankin et al. ..... 175/62
2003/0205409 A1 * 11/2003 Koch et al. ..... 175/26

* cited by examiner

*Primary Examiner*—Shane Bomar
(74) *Attorney, Agent, or Firm*—Chambliss, Bahner & Stophel, P.C.

(57) ABSTRACT

A control system for controlling at least one function of an item of construction equipment. The control system includes a pump, a proportional control valve, a directional control valve, a signal source, a switch, and a processor. The proportional control valve is in fluid communication with the pump and the directional control valve is in fluid communication with the proportional control valve. The switch is adapted to be in an open position and in a closed position. The processor is adapted to receive a processor input, receive the signal from the signal source, and transmit a processor output to the proportional control valve. The switch transmits a false signal to the processor when it is in the open position and a true signal when it is in the closed position. The control system is adapted to control the at least one function of the item of construction equipment.

18 Claims, 3 Drawing Sheets

CONTROL SYSTEM

CROSS-REFERENCES TO RELATED APPLICATIONS/PATENTS

This application relates to and seeks priority from U.S. Provisional Patent Application No. 60/761,991 filed on Jan. 25, 2006, and entitled "Control System."

FIELD OF THE INVENTION

The present invention relates generally to control systems for controlling the functions of items of construction equipment, and particularly to control systems for controlling the auxiliary functions of a horizontal directional drilling assembly.

BACKGROUND AND DESCRIPTION OF THE PRIOR ART

Many utility lines, pipelines and other underground components are installed in or under the ground by boring a borehole in a generally-horizontal direction in the ground rather than by digging a trench. This type of construction, which is sometimes referred to as "horizontal boring", "directional drilling" or "horizontal directional drilling", eliminates the need to excavate earth in order to install an underground component, and thereby saves several steps in the installation process. If no trench is dug, there will be no trench to fill, and no disturbed surface to reclaim. The horizontal drilling machine may be operated to drill a pilot bore along a planned path underground. Typically, the planned path is generally arcuate in shape from the entry point at the surface of the ground, continuing underneath a roadway, river or other obstacle, to the exit point at the surface on the other side of the obstacle.

A typical directional drilling machine includes a thrust frame that can be aligned at an oblique angle with respect to the ground. Mounted on a drive carriage on the thrust frame is a pipe-rotation mechanism that is adapted to rotate a series of interconnected pipe sections (commonly referred to as a drill string) about a boring axis. The drive carriage also includes a carriage drive assembly that is adapted to push the carriage along the thrust frame. The combination of rotation of the drill string and longitudinal movement of the drive carriage along the thrust frame causes the drill string to be advanced into or withdrawn from the ground.

To drill a hole using a directional drilling machine, the thrust frame is oriented at an oblique angle relative to the ground, and the drive carriage is retracted to an upper end of the frame. A pipe section is unloaded from a magazine and is coupled to the pipe-rotation mechanism on the drive carriage. A boring tool or cutting head is mounted to the distal end of the pipe, and the drive carriage is driven in a downward direction along the inclined thrust frame. As the drive carriage is driven downwardly, the pipe-rotation mechanism rotates the pipe about the boring axis, thereby causing the pipe (with boring tool mounted thereon) to drill or bore a hole.

As the drilling operation proceeds, the drill string is lengthened by adding pipe sections to the string. Typically, the pipe sections are provided with a male threaded connector on one end and a female threaded connector on the other end. Each time a pipe section is added to the drill string, the pipe section being added is aligned with the drill string and the threaded connector on its distal end is mated with the threaded connector on the proximal end of the drill string. Obviously, either the pipe section being added or the drill string must be restrained against rotation while the other component is rotated to engage the threaded connector on the distal end of the pipe section with the threaded connector on the proximal end of the drill string to create a secure threaded connection between the components.

During drilling using a horizontal directional drill, drilling fluid can be pumped through the drill string, over the boring tool at the distal end of the drill string and back up through the hole, to remove cuttings and displaced dirt. After the boring tool reaches a desired depth, it can be directed along a generally horizontal path and back up to break the surface of the ground at a distant point. To control the direction of the borehole, a boring tool with an angled-face may be used. When the direction of the borehole must be changed, the drill bit is positioned with the angled-face oriented in the desired direction. The drill string is then pushed through the ground without rotation, and the angled-face of the boring tool causes the drill string to deflect in the desired direction. This ability to change the direction of travel of the drill string also allows the operator to steer the drill string around underground obstacles like large roots and rocks.

Sufficient lengths of pipe are added to the drill string as needed to reach the exit point where the boring tool emerges from the earth. When the original bore is complete, it may be enlarged by replacing the boring tool with an enlarging device, commonly known as a backreamer. The backreamer is connected to the distal end of the drill string and moved through the original bore back towards the boring machine, either with or without rotation of the drill string. The backreamer expands and stabilizes the walls of the bore, generally while pulling a utility line or other underground component through the enlarged bore behind it. Movement of the backreamer back towards the drilling machine is accomplished by driving the drive carriage in a rearward direction on the thrust frame to withdraw a pipe section, disconnecting the withdrawn pipe section from the drill string, connecting the next pipe section in the drill string to the pipe rotation mechanism on the drive carriage and repeating the process until all of the pipe sections have been withdrawn from the ground. As each pipe section in the drill string is uncoupled from the drill string, it is loaded back into the pipe section magazine of the directional drilling machine.

To enhance drilling productivity, it is important to maximize the efficiency with which pipe sections can be loaded into and unloaded from the magazine. Until fairly recently, pipe sections were manually carried between the magazine and the pipe rotation mechanism of a drilling machine, and were also manually loaded into and unloaded from the magazine. Recent developments, however, have improved pipe loading and unloading efficiencies, primarily through automation. The loading and unloading of pipe sections is commonly referred to as one of the many auxiliary functions performed by a horizontal directional drilling assembly.

Indeed, conventional horizontal directional drilling assemblies perform a number of auxiliary functions. The term auxiliary function refers to any function not directly effecting the primary functions of the drilling assembly. The primary functions of a drilling assembly are drilling a borehole and placing a drill string in the borehole. Auxiliary functions include pipe loading, wrench and setup functions. Conventional auxiliary functions frequently do not operate at the same hydraulic flow due to space and functionality restraints of the various functions. These differences result in control systems that use flow compensated hydraulic valves adapted to enable the system to supply varied flows to the auxiliary functions. Also in conventional control systems for controlling the auxiliary functions of a horizontal directional drilling assembly, the activation of a switch directly operates the flow compensated valve section associated with each auxiliary function. As a result, the components of conventional control systems, including the main control valve, are large and expensive. In addition, the components of conventional control systems are difficult to locate, remove, maintain, repair and replace. Further, in horizontal directional drilling assemblies having a conventional control system, the hydraulic valves must be taken apart in order to change the flow settings for the different auxiliary functions.

It would be desirable, therefore, if a control system for controlling the functions of an item of construction equipment could be provided that would use smaller and less expensive components that are easier to locate, remove, maintain, repair and replace. It would also be desirable is such a control system could be provided that would permit the user to easily change flow settings for different auxiliary functions.

ADVANTAGES OF THE PREFERRED EMBODIMENTS OF THE INVENTION

Accordingly, it is an advantage of the preferred embodiments of the invention described herein to provide a control system for controlling the functions of an item of construction equipment that uses relatively small and inexpensive components that are easy to locate, remove, maintain, repair and replace. It is also an advantage of the preferred embodiments of the control system to permit the user to easily change flow settings for different auxiliary functions.

Additional advantages of the invention will become apparent from an examination of the drawings and the ensuing description.

Explanation of Technical Terms

As used herein, the term "auxiliary function" refers to any function not directly effecting the primary functions of the drilling assembly, i.e. drilling a borehole and placing a drill string in the borehole. It is contemplated that the term "auxiliary function" includes functions that assist, facilitate, support or contribute to the primary functions of the drilling assembly. It is also contemplated that the term "auxiliary function" includes functions that are ancillary or subsidiary to the primary functions of the drilling assembly. The term "auxiliary function" includes, without limitation, functions such as pipe loading, wrench and setup functions.

As used herein, the term "construction equipment" refers to any tools, devices, mechanisms, constructions, structures and the like used in the construction industry and adapted to perform a function as that term is defined below. The term "construction equipment" includes, without limitation, a horizontal directional drilling assembly as that term is defined below.

As used herein, the term "directional control valve" refers to any device, mechanism, apparatus, structure or the like adapted to control the flow of fluid, at the desired time, to the location in a process system where a function, as that term is defined below, is performed. The term "directional control valve" includes, without limitation, valves commonly referred to as selector valves and transfer valves. The term "directional control valve" includes, without limitation, spool, globe, diaphragm, pinch, knife, gate, needle, butterfly, ball, cock, stop-cock and plug control valves. The term "directional control valve" also includes, without limitation, valves that are actuated by electricity, pneumatic fluid, hydraulic fluid and manual means.

As used herein the term "external force" refers to any stimulus or agent adapted to cause a switch, as defined herein, to open and/or close. The term "external force" includes, without limitation, mechanical forces and stimuli or agents that are optical, acoustic, chemical, tactile, electrical, electronic and/or electromagnetic in nature.

As used herein, the term "false signal" refers to any signal transmitted to a processor that does not cause the processor to produce a processor output. The term "false signal" also contemplates that no signal is transmitted to the processor such that the processor does not produce a processor output.

As used herein, the term "function" refers to any task or activity performed by an item of construction equipment as that term is defined above. The term "function" includes, without limitation, auxiliary functions, as that term is defined above, performed by a horizontal directional drilling assembly as that term is defined below. More particularly, the term "function" includes, without limitation, driving a piston in a hydraulic cylinder.

As used herein, the term "horizontal directional drilling assembly" refers to an item of construction equipment adapted to drill holes and the like beneath the surface of the ground in a direction generally parallel to the surface of the ground. The term "horizontal directional drilling assembly" also includes, without limitation, drilling assemblies that are adapted to drill holes and the like beneath the surface of the ground at angles relative to the surface of the ground, including holes that are generally perpendicular to the surface of the ground for a portion of their length.

As used herein, the term "momentary contact switch" refers to a switch that is automatically closed when it is contacted by an external force, automatically opened when it is not contacted by an external force, and automatically maintained in a closed position when it is continuously contacted by an external force.

As used herein, the term "processor" refers to any device that is adapted to receive, interpret and/or execute instructions.

As used herein, the term "processor output" refers to the driving force that is delivered by the processor to the proportional control valve section based upon the instructions interpreted and/or executed by the processor. The term "processor output" includes, but is not limited to, driving forces such as voltage, amperage and any combination thereof.

As used herein, the term "proportional control valve" refers to any device, mechanism, apparatus, structure or the like adapted to modify fluid flow or pressure rate in a process system. The term "proportional control valve" includes, without limitation, spool, globe, diaphragm, pinch, knife, gate, needle, butterfly, ball, cock, stop-cock and plug control valves. The term "proportional control valve" also includes, without limitation, valves that are actuated by electricity, pneumatic fluid, hydraulic fluid and manual means.

As used herein, the term "pump" refers to any device, mechanism or other structure adapted to convert mechanical energy into fluid energy.

As used herein, the term "signal" refers to any transmitted electrical impulse, electric current, electromagnetic wave and any combination thereof. As noted above, the term "signal" also contemplates the absence of a signal in the context of a "false signal" as that term is defined above.

As used herein, the term "signal source" refers to any apparatus, device, combination, system, process, method or means adapted to produce a signal, as defined herein. The term "signal source" includes devices, combinations, systems, processes, methods and means adapted to produce an electrical impulse, an electric current, an electromagnetic wave and any combination thereof.

As used herein, the term "switch" refers to any device that may be opened so as to prevent the transmission of a signal and/or closed so as to permit the transmission of a signal. The term "switch" includes, but is not limited to, devices that are manual, automatic and any combination thereof.

SUMMARY OF THE INVENTION

The invention comprises a control system for controlling at least one function of an item of construction equipment. The control system includes a pump, a proportional control valve, a directional control valve, a signal source, a switch, and a processor. The proportional control valve is in fluid communication with the pump and the directional control valve is in fluid communication with the proportional control valve. The signal source is adapted to produce a signal and the switch is adapted to be in an open position and in a closed position. The processor is adapted to receive a processor input, receive the signal from the signal source, and transmit a processor output to the proportional control valve. The switch transmits a false signal to the processor when the switch is in the open position. The switch transmits a true signal to the processor when the switch is in the closed position. The control system is adapted to control the at least one function of the item of construction equipment.

In the preferred embodiment of the control system, the control system further comprises a plurality of directional control valves, each of which corresponds to one of the at least one functions of the item of construction equipment. The preferred control system also includes a plurality of signal sources adapted to produce a plurality of signals and a plurality of switches, each of which is adapted to transmit a first signal to one of the plurality of directional control valves and a second signal to one of a plurality of processor inputs. In the preferred control system, the processor is adapted to receive the plurality of processor inputs and the plurality of signals, and the processor output is determined by the lowest processor input from the processor inputs that receive a true signal. Further, in the preferred control system, for each of the plurality of switches, the first signal is transmitted to the directional control valve that corresponds with the same one of the at least one functions as the processor input to which the second signal is transmitted.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
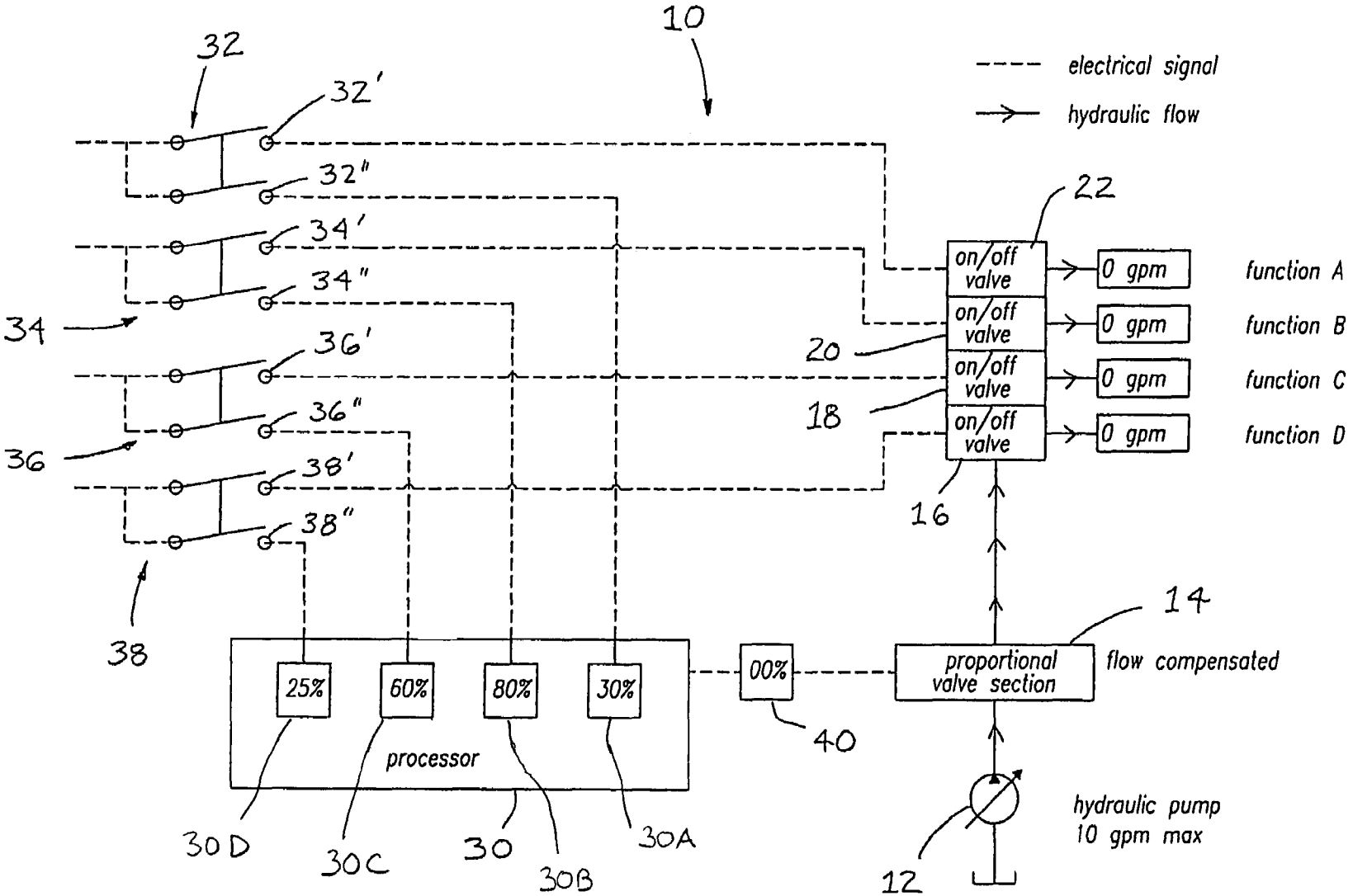
FIG. 1 is a schematic drawing of the preferred control system for controlling the auxiliary functions of a horizontal directional drilling assembly in accordance with the present invention.
Figure 2:
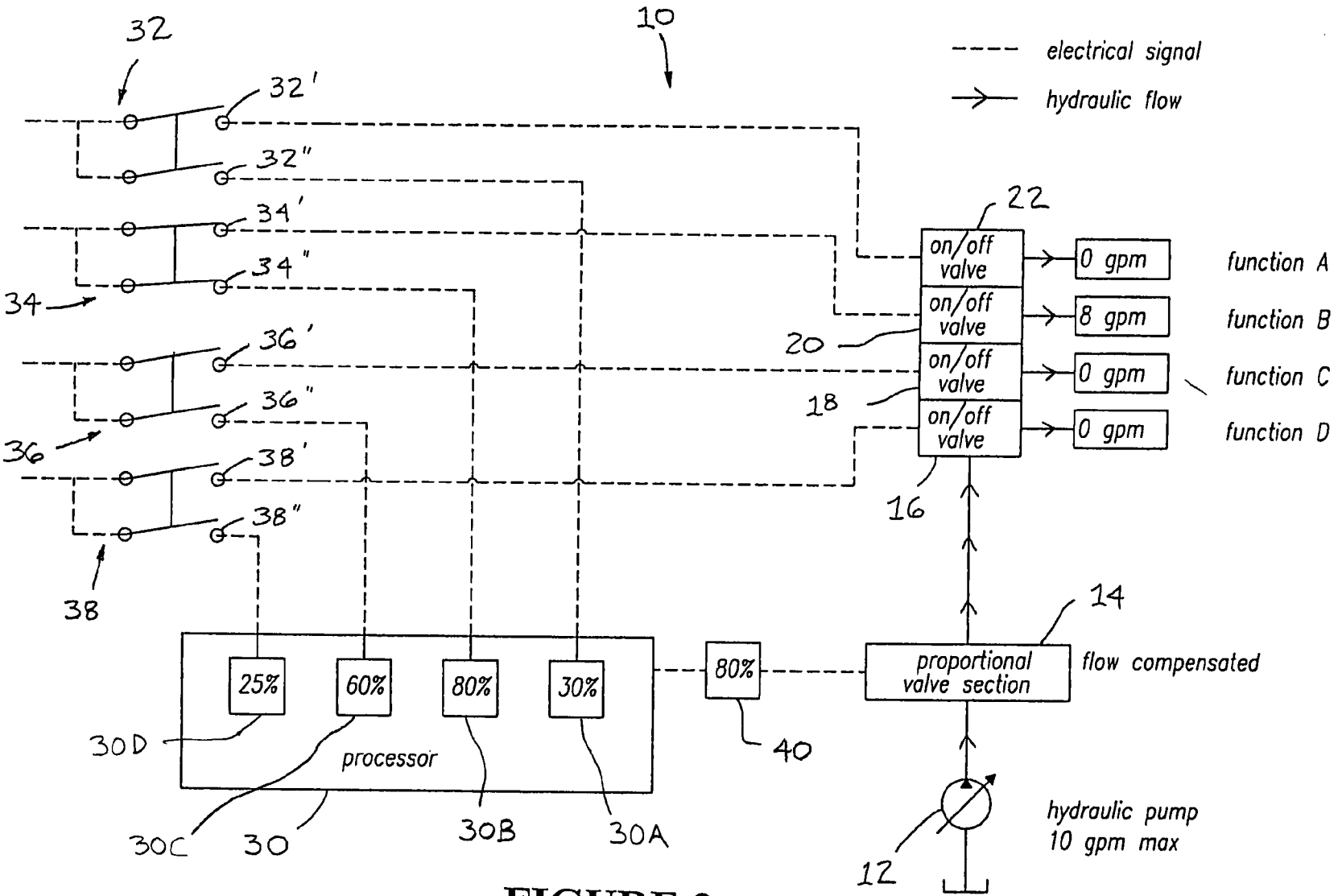
FIG. 2 is a schematic drawing of the preferred control system for controlling the auxiliary functions of a horizontal directional drilling assembly illustrated in FIG. 1 showing a single auxiliary function activated.
Figure 3:
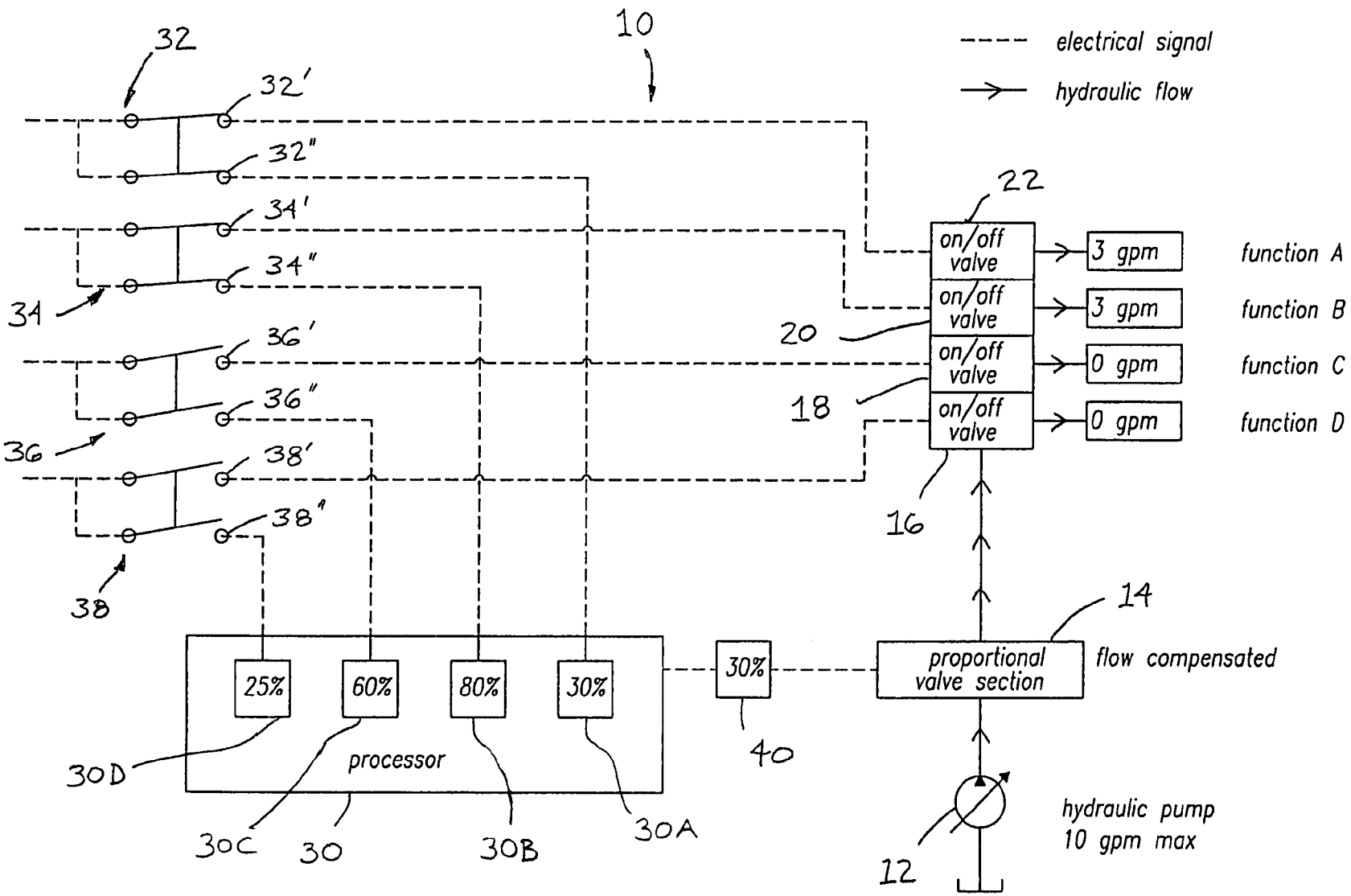
FIG. 3 is a schematic drawing of the preferred control system for controlling the auxiliary functions of a horizontal directional drilling assembly illustrated in FIGS. 1 and 2 showing a pair of auxiliary functions activated.

Referring now to the drawings, the preferred embodiment of the control system for controlling the functions of an item of construction equipment is illustrated in FIGS. 1 through 3. More particularly, FIGS. 1 through 3 illustrate the preferred control system for controlling the auxiliary functions of a horizontal directional drilling assembly. The preferred control system is designated generally by reference numeral 10. The preferred control system 10 is adapted to control a plurality of auxiliary functions such as pipe loading, wrench and setup functions. The preferred control system 10 is adapted to control such auxiliary functions through the control of a hydraulic or pneumatic actuator. The plurality of auxiliary functions are designated generally as "function A", "function B", "function C" and "function D". While FIGS. 1 through 3 illustrate a control system for controlling for auxiliary functions of a horizontal directional drilling assembly, it is contemplated within the scope of the invention that more or less than four auxiliary functions may be controlled by the preferred control system of the invention. It is further contemplated that the preferred control system may be used to control the primary functions of a drilling assembly or a combination of primary and auxiliary functions. It is still further contemplated that the preferred control system may be used to control the primary and/or auxiliary functions of a different type of construction equipment.

As shown in FIGS. 1 through 3, electrical signals are represented by dashed lines and hydraulic flow is represented by solid lines having arrows. The configuration and arrangement of the dashed lines and the solid lines having arrows are merely representative of the paths of travel of the electrical signals and hydraulic flow, respectively, of the preferred control system. It is contemplated within the scope of the invention, however, that the paths of travel of the electrical signals and hydraulic flow may be any suitable configuration and arrangement.

Still referring to FIGS. 1 through 3, the preferred control system 10 includes a device for producing a fluid flow such as hydraulic pump 12 which is adapted to pump fluid and produce a flow of hydraulic fluid in the system. While the preferred pump 12 is identified in the drawings as a hydraulic pump having a maximum capacity of 10 gpm, it is contemplated within the scope of the invention that any suitable device for producing a fluid flow may be used such as a pneumatic pump, a water pump and the like. It is also contemplated that the device for producing a fluid flow may have a higher or lower maximum capacity than 10 gpm. The preferred pump 12 pumps hydraulic fluid to proportional control valve section 14. The preferred proportional control valve section 14 includes a hydraulic proportional control valve that is in fluid communication with the pump. The preferred proportional control valve section 14 is adapted to convey hydraulic fluid to a plurality of non-flow compensated on/off directional control valves 16, 18, 20 and 22. While the preferred proportional control valve section 14 includes a hydraulic proportional control valve, it is contemplated within the scope of the invention that the proportional control valve section may include any suitable valve or any suitable combination of valves.

Referring still to FIGS. 1 through 3, the preferred non-flow compensated on/off directional control valves 16, 18, 20 and 22 are in fluid communication with the proportional control valve and adapted to convey hydraulic fluid to the components of the horizontal directional drilling assembly that effectuate the auxiliary functions of the drilling assembly such as hydraulic cylinders or actuators. As shown in FIGS. 1 through 3, in the preferred control system, each of the plurality of directional control valves corresponds to one of the plurality of auxiliary functions and corresponds to one of the plurality of switches. While the preferred control system includes non-flow compensated on/off directional control valves 16, 18, 20 and 22, it is contemplated within the scope of the invention that any suitable valve may be used to convey hydraulic fluid to the components of the drilling assembly that effectuate the auxiliary functions. Further, while FIGS. 1 through 3 illustrate four preferred on/off directional control valves 16, 18, 20 and 22, it is contemplated within the scope of the invention that the preferred control system may include more or less than four on/off directional control valves.

Still referring to FIGS. 1 through 3, the preferred control system also includes onboard processor 30. The preferred onboard processor 30 is adapted to be in electrical communication with the preferred proportional control valve section 14 and the preferred plurality of switches 32, 34, 36 and 38. In addition, the preferred onboard processor 30 is adapted to receive an electrical signal from each of the preferred plurality of switches 32, 34, 36 and 38 and transmit a processor output 40 to the preferred proportional control valve section 14. The preferred processor output is an electrical signal. For each preferred function A, B, C and D, the preferred processor 30 is adapted to receive a processor input, 30A, 30B, 30C and 30D, respectively. As shown in FIGS. 1 through 3, in the preferred control system, each of the plurality of processor inputs corresponds to one of the plurality of auxiliary functions and corresponds to one of the plurality of switches. While the preferred processor inputs 30A, 30B, 30C and 30D are illustrated as percentages, it is contemplated that the amount or value of the processor inputs may be expressed in any suitable unit of measurement.

Referring still to FIGS. 1 through 3, each of the preferred switches 32, 34, 36 and 38 is adapted to be opened and closed to as to transmit a first electrical signal to the preferred plurality of non-flow compensated on/off directional control valves 16, 18, 20 and 22 and a second electrical signal to preferred processor 30 in the preferred control system, the first signal is transmitted to the directional control valve that corresponds with the same one of the plurality of auxiliary functions as the processor input to which the second signal is transmitted. As shown in FIGS. 1 through 3, each preferred switch 32, 34, 36 and 38 has a first output 32', 34', 36' and 38', respectively, and a second output 32", 34", 36" and 38", respectively. Each of the preferred first outputs 32', 34', 36' and 38' is in electrical communication with one of the preferred plurality of non-flow compensated on/off directional control valves. Each of the preferred second outputs is in electrical communication with preferred processor 30. Each of the preferred switches 32, 34, 36 and 38 functions as a logic gate for processor 30. More particularly, when each preferred switch is in the open position, it transmits a false signal to the processor. A false signal may include, but is not limited to, no signal. When every preferred switch is open, no signals are transmitted to the processor, no processor output is produced, and no functions are activated. FIG. 1 illustrates the preferred control system 10 with every switch in the open position. As shown in FIG. 1, no signals are sent to processor 30, processor output 40 is 0%, and there is no hydraulic flow to any of the functions.

By contrast, when each preferred switch is in the closed position, it transmits a true signal to processor 30. FIG. 2 illustrates the preferred control system 10 having a single switch closed, i.e. switch 34. As shown in FIG. 2, when a single preferred switch is closed, processor 30 receives a true signal from the closed switch, and transmits to proportional control valve section 14 a processor output in the amount or value of the processor input that corresponds to the closed switch. In FIG. 2, the processor input 30B is identified as 80%. Consequently, the processor output is 80%. Thereafter, proportional control valve section 14 conveys to activated on/off directional control valve 20 the proper hydraulic flow in accordance with the amount or value of processor output 40. As shown in FIG. 2, on/off directional control valve 20 conveys to function B a hydraulic flow of 8 gpm, which is 80% of the maximum capacity of pump 12.

Referring now to FIG. 3, a pair of preferred switches, 32 and 34, are closed. As a result, switch 32 and switch 34 each send a true signal to processor 30. As shown in FIG. 3, processor input 30A is 30% and processor input 30B is 80%. In the preferred control system 10, processor 30 is adapted to produce a processor output that is determined by the lowest value among the plurality of processor inputs that receive a true signal. As a result, the preferred processor 30 produces a processor output that is no greater than the lowest processor input among the functions activated by the switches. As shown in FIG. 3, processor output 40 is 30% which represents the lowest of the two processor inputs corresponding to functions that have been activated, i.e. by closed switches 32 and 34. Thereafter, proportional control valve section 14 conveys to the activated on/off directional control valves 20 and 22 the proper hydraulic flow in accordance with the amount or value of processor output 40. As shown in FIG. 3, on/off directional control valve 20 conveys to function B a hydraulic flow of 3 gpm, which is 30% of the maximum capacity of pump 12. Similarly, on/off directional control valve 22 conveys to function A a hydraulic flow of 3 gpm, which is 30% of the maximum capacity of pump 12.

Referring again to FIGS. 1 through 3, exemplary signal sources 42, 44, 46 and 48 are schematically represented. As shown in FIGS. 1 through 3, each preferred switch 32, 34, 36 and 38 is adapted to receive a signal from one of the signal sources. The preferred signal source produces an electrical signal or a plurality of electrical signal. While FIGS. 1 through 3 illustrate a single signal source 42, 44, 46 and 48 for each switch 32, 34, 36 and 38, it is contemplated that the preferred control system of the invention may include more or less that one signal source for each switch. Further, each preferred switch 32, 34, 36 and 38 is adapted to be activated by applying an external force to the switch. Still further each preferred switch 32, 34, 36 and 38 is a momentary contact switch. It is contemplated within the scope of the invention, however, that the plurality of switches may be any suitable device adapted to be opened and closed so as to transmit a signal. It is also contemplated within the scope of the invention that the preferred control system includes more or less than four switches. It is further contemplated within the scope of the invention that each of the preferred switches includes more or less than two outputs.

In operation, several advantages of the preferred embodiments of the invention are achieved. For example, by using the onboard processor, a proportional control valve section and a plurality of non-flow compensated on/off directional control valves, the preferred control system achieves the same functionality as conventional control systems using smaller and less expensive components that are easier to locate, remove, maintain, repair and replace on the drilling assembly. In addition, the preferred control system provides the user with a system in which flow settings for different auxiliary functions may be easily changed.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A control system for controlling at least one function of an item of construction equipment, said control system comprising:

(a) a pump;

(b) a proportional control valve, said proportional control valve being in fluid communication with the pump;

(c) a plurality of on/off directional control valves, each of said on/off directional control valves being in fluid communication with the proportional control valve and each of said plurality of on/off directional control valves corresponding to one of the at least one functions of the item of construction equipment;

(d) a plurality of signal sources, said plurality of signal sources being adapted to produce a plurality of signals;

(e) a plurality of switches, each of said plurality of switches being adapted to be in an open position and in a closed position and each of said plurality of switches being adapted to transmit a first signal to one of the plurality of on/off directional control valves and a second signal to one of a plurality of processor inputs;

(f) a processor, said processor being adapted to receive a plurality of processor inputs, receive the plurality of signals from the plurality of signal sources, and transmit a processor output to the proportional control valve;

wherein the switch transmits a false signal to the processor when the switch is in the open position; and wherein the switch transmits a true signal to the processor when the switch is in the closed position; and wherein the processor output is determined by the lowest processor input from the processor inputs that receive a true signal; and wherein the control system is adapted to control the at least one function of the item of construction equipment.

2. The control system of claim 1 wherein the pump, the proportional control valve and the on/off directional control valve are adapted to convey fluid.

3. The control system of claim 1 wherein the signal produced by the signal source is an electrical signal.

4. The control system of claim 1 wherein the switch is adapted to transmit a first signal to the on/off directional control valve and a second signal to the processor.

5. The control system of claim 1 wherein the switch is a momentary contact switch.

6. The control system of claim 1 wherein the switch is activated by an external force.

7. The control system of claim 1 wherein the processor output is an electrical signal.

8. The control system of claim 1 wherein the at least one function of the item of construction equipment that is controlled by the control system includes an auxiliary function.

9. The control system of claim 1 wherein the item of construction equipment is a horizontal directional drilling assembly.

10. The control system of claim 1 wherein the control system is adapted to control at least one hydraulic or pneumatic actuator.

11. The control system of claim 1 wherein, for each of the plurality of switches, the first signal is transmitted to the on/off directional control valve that corresponds with the same one of the at least one functions as the processor input to which the second signal is transmitted.

12. A control system for controlling a plurality of auxiliary functions of a horizontal directional drilling assembly, said control system comprising:

(a) a pump, said pump being adapted to pump fluid;

(b) a proportional control valve, said proportional control valve being in fluid communication with the pump;

(c) a plurality of on/off directional control valves, each of said plurality of on/off directional control valves being in fluid communication with the proportional control valve;

(d) a signal source adapted to produce a plurality of signals;

(e) a plurality of switches, each of said plurality of switches being adapted to be in an open position and in a closed position;

(f) a processor, said processor being adapted to receive a plurality of processor inputs, receive the plurality of signals from the signal source, and transmit a processor output to the proportional control valve;

wherein each of the plurality of on/off directional control valves corresponds to one of the plurality of auxiliary functions and corresponds to one of the plurality of switches; and wherein each of the plurality of processor inputs corresponds to one of the plurality of auxiliary functions and corresponds to one of the plurality of switches; wherein each of the plurality of switches transmits a false signal to the processor when the switch is in the open position; and wherein each of the plurality of switches transmits a true signal to the processor when the switch is in the closed position; and wherein each of the plurality of switches is adapted to transmit a first signal to one of the plurality of on/off directional control valves and a second signal to one of the plurality of processor inputs: and wherein the processor output is determined by the lowest value among the plurality of processor inputs that receive a true signal; and wherein the control system is adapted to control the plurality of auxiliary functions of the horizontal directional drilling assembly.

13. The control system of claim 12 wherein the plurality of signals produced by the signal source are electrical signals.

14. The control system of claim 12 wherein each of the plurality of switches is adapted to transmit a first signal to one of the plurality of on/off directional control valves and transmit a second signal to one of the plurality of processor inputs.

15. The control system of claim 12 wherein the processor output is an electrical signal.

16. The control system of claim 12 wherein the auxiliary functions include pipe loading functions, wrench functions and setup functions.

17. The control system of claim 12 wherein the control system is adapted to control at least one hydraulic or pneumatic actuator.

18. The control system of claim 12 wherein, for each of the plurality of switches, the first signal is transmitted to the on/off directional control valve that corresponds with the same one of the plurality of auxiliary functions as the processor input to which the second signal is transmitted.

* * * * *